US005951360A

United States Patent [19]

Fearon et al.

[11] Patent Number: 5,951,360

[45] Date of Patent: Sep. 14, 1999

[54] INFANT MOBILE WITH COMPACT DISC/ CASSETTE PLAYER APPARATUS

[76] Inventors: Beatrice B. Fearon; Nichole Alleyne, both of 255-31-149th Rd., Rosedale, N.Y. 11422

[21] Appl. No.: 09/045,783

[22] Filed: Mar. 20, 1998

[51] Int. Cl.[6] ..... A63H 33/00

[52] U.S. Cl. ..... 446/227; 446/242

[58] Field of Search ..... 446/227, 242, 446/265; 40/414, 455, 473

[56] References Cited

U.S. PATENT DOCUMENTS

| | | | |
|---|---|---|---|
| D. 349,735 | 8/1994 | Cacciola et al. | D21/63 |
| D. 364,652 | 11/1995 | Santana | D21/63 |
| 3,983,647 | 10/1976 | Stubbmann | 40/28.1 |
| 4,207,696 | 6/1980 | Hyman et al. | 40/473 |
| 4,363,181 | 12/1982 | Hyman | 40/466 |
| 4,640,034 | 2/1987 | Zisholtz | 40/455 |
| 4,756,109 | 7/1988 | Marcus | 40/613 |
| 4,984,380 | 1/1991 | Anderson | 40/455 |
| 5,370,570 | 12/1994 | Harris | 446/227 |
| 5,672,088 | 9/1997 | Chininis | 446/227 |
| 5,803,786 | 9/1998 | McCormick | 446/227 |

*Primary Examiner*—Robert A. Hafer
*Assistant Examiner*—Jeffrey D. Carlson
*Attorney, Agent, or Firm*—John D. Gugliotta

[57] ABSTRACT

An infant mobile with compact disc/cassette player apparatus is disclosed. The invention comprises a combination compact disc player and a cassette player for playing music that is effective in soothing or stimulating an infant, and a structure for hanging mobile fixtures over the infant. The apparatus is attached to the side of an infant's crib or playpen in a conventional manner. The mobile fixtures turn in a synchronized response to the music characteristics. The parent or care giver is provided the option of playing music continuously, allowing the device to self actuate in response to motion on the part of the infant, or allowing the mobile to turn in response to sounds made by the infant. The control of the compact disc and cassette player is also available via an infrared remote control. The mobile structure is detachable to allow for the use of the music reproduction system by itself as the child grows older.

6 Claims, 5 Drawing Sheets

INFANT MOBILE WITH COMPACT DISC/ CASSETTE PLAYER APPARATUS

BACKGROUND OF THE INVENTION

1. Field of the Invention

The present invention relates generally to infant mobiles used on cribs and, more particularly, to an infant mobile with compact disc/cassette player apparatus.

2. Description of the Related Art

Children are a blessed addition to a family. As every parent knows, infants require considerable stimulation both audibly and visually to ensure that the child grows up normally and flourishes. These stimulations are also important in instilling in the infant a sense of security via a repeated audible and visual stimulation that is familiar to the infant. These stimulations let the infant know that he or she is in their normal environment and that all is well. The use of physical toys or objects also allow for the development of touch and depth perception by the reaching out action of the infant's hands to grasp said toys or objects. Scientific studies have shown repeatedly that an infant that is provided with physical stimulation means develops more quickly than an infant who is not provided with such stimulation. Additionally, external stimulation by other physical means allows for greater time for the parent or care giver to attend to other important matters, and reduces the time the infant may spend in a state of unexplained irritability, fussing, or crying.

One of the most common approaches to providing infants with audible, visual and physical stimulation has been through the use of mobiles attached to the infant's crib or playpen. Throughout the years the most common approach has been to provide a mobile, equipped with a wind up music box to provide such stimulation. The most common problem with such an approach is that the wind up music box only provides stimulation until the wind up mechanism stops, which is limited to only a short duration on the order of a few minutes. At this point the child's attention will be lost.

The previous art consists of many examples of devices designed to overcome the shortcomings of conventional mobiles. Examples of these devices include U.S. Pat. No. 3,983,647, issued in the name of Stubbmann, in which the mobile fixtures rotate around a horizontal axis, U.S. Pat. No. D 364,652, issued in the name of Santana, which discloses mobile fixtures which glow in the dark and U.S. Pat. No. D 349,735, issued in the name of Cacciola, which also discloses a mobile which rotates around a horizontal axis. While a mobile constructed in accordance with these disclosures will certainly entertain an infant, they also possess many shortcomings themselves. These problems include the above-mentioned problem of short running times and no response to actions by the infant.

U.S. Pat. No. 4,207,696, issued in the name of Hyman, et al. addresses these problems by the use of a motion sensor which allows for the activation of the mobile when the infant moves, and the use of a long term energy storage device, but no music reproduction for the purposes of sound stimulation. U.S. Pat. No. 4,363,181, issued in the name of Hyman, et al. allows for the use of sound reproduction, but not the use of motion detection on the part of the infant to allow for mobile control.

U.S. Pat. No. 4,984,380, issued in the name of Anderson, addresses the aforementioned problems, by the use of a motion sensor and external sound reproduction means. A device constructed in accordance with this disclosure however is very large and attached to the dwelling room in which the crib or playpen is located. It is also only operated on alternating current and is therefore not easily relocated.

Another problem associated with conventional mobiles and the aforementioned prior art is that they are capable of playing only one set of musical tunes. This not only becomes monotonous for the infant after a time, but also for the parent or care giver, who must endure listening to it as well. U.S. Pat. No. 4,640,034, issued in the name of Zisholtz, discloses a mobile which utilizes a cassette player in which the parent or care giver may play varying musical tunes, and which may start and stop dependent upon movement of the infant. A problem associated with this approach, is that while the music may vary, the mobile fixtures turn only in a constant, non-varying pattern, which may cause the infant to stop paying attention. Also, current technology of music reproduction is utilizing the compact disc, which in many cases certain musical selections are only released on compact disc. This may prevent the parent or care giver from playing certain music they want the infant to hear. A final problem with a device constructed in accordance with this disclosure is that no remote control operation of the device is possible. This forces the parent or care giver to actuate controls directly on the device which may disturb the child that is in the early stages of falling asleep.

A search of the prior art did not disclose any patents that read directly on the claims of the instant invention.

Consequently, a need has been felt for providing an apparatus and method which overcomes the problems cited above.

SUMMARY OF THE INVENTION

It is therefore an object of the present invention to provide an improved infant mobile with compact disc/cassette player apparatus.

Briefly described according to the preferred embodiment of the present invention, an infant mobile with compact disc/cassette player apparatus is composed of a combination compact disc player and a cassette player for playing music that is effective in soothing or stimulating an infant, and a structure for hanging mobile fixtures over the infant. The apparatus is attached to the side of an infant's crib or playpen in a conventional manner. The mobile fixtures turn in a synchronized response to the music characteristics. The parent or care giver is provided the option of playing music continuously, allowing the device to self actuate in response to motion on the part of the infant, or allowing the mobile to turn in response to sounds made by the infant. The control of the compact disc and cassette player is also available via an infrared remote control. The mobile structure is detachable to allow for the use of the music reproduction system by itself as the child grows older.

It is another object of the present invention to provide a device that can play an almost infinite number of musical selections based upon the wishes of the parent or care giver. This has several benefits. First, the infant as well as the parent or care giver is relieved from hearing the same monotonous tune over and over again. Second, a soft, soothing lullaby may be played when the child is put down to go to sleep or take a nap. Third, stimulating music or a sing-a-long may be played at times when the child is not tired and needs to be entertained, or when the parent or care giver does not want the child to fall asleep. Fourth, soothing tunes that the infant has found comforting may be moved and used in other locations such as at day care or in an automobile, to help soothe and comfort the infant. Finally, the music selections can grow with the infant.

It is another object of the present invention to provide an apparatus that can play both audio cassettes as well as compact discs.

It is another object of the present invention to provide an apparatus that rotates the mobile fixtures in response to the music characteristics, thus increasing the entertainment value to the infant.

It is another object of the present invention to provide for the self actuation of the music playback device as well as the rotation of the mobile fixtures in response to movement of the infant. This has several benefits. First, it allows the parent or care giver to know the infant has fallen asleep by the cessation of music. Second, it allows the parent or care giver to know the child is moving or awaking by the resumption of music playback. Finally, the resumption of music playback may allow the infant to fall back asleep on his or her own without the intervention of a parent or care giver.

It is another object of the present invention to provide an apparatus that is directly controlled by sounds made by the infant. Such stimulation allows for increased entertainment value by allowing the infant to control his or her environment. Such stimulation may also aid in early speech development and other knowledge-based areas.

It is another object of the present invention to provide an apparatus that is portable in nature and thus easily moved from an infant's crib to a playpen or other location.

It is another object of the present invention to provide for a removable compact disc player and cassette player that may be used when the child grows older. This aids in increased cost savings on the part of the consumer by eliminating redundant purchases to play musical material.

It is another object of the present invention to provide an apparatus that is controllable both locally at the device and remotely via an infrared control port.

It is another object of the present invention to provide a device that can be easily produced using existing technology, materials and assembly techniques.

It is another object of the present invention to provide a device that is aesthetically pleasing, which can be designed in a variety of styles and colors.

Another advantage of the present invention is that it is simple, and therefore, inexpensive to manufacture. This savings, if passed on to the consumer, may influence the public to utilize such a device. A simple design also increases product reliability and useful product lifetime.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

In order to describe the complete relationship of the invention, it is essential that some description be given to the manner and practice of functional utility and description of an infant mobile with compact disc/cassette player apparatus.

Figure 1:
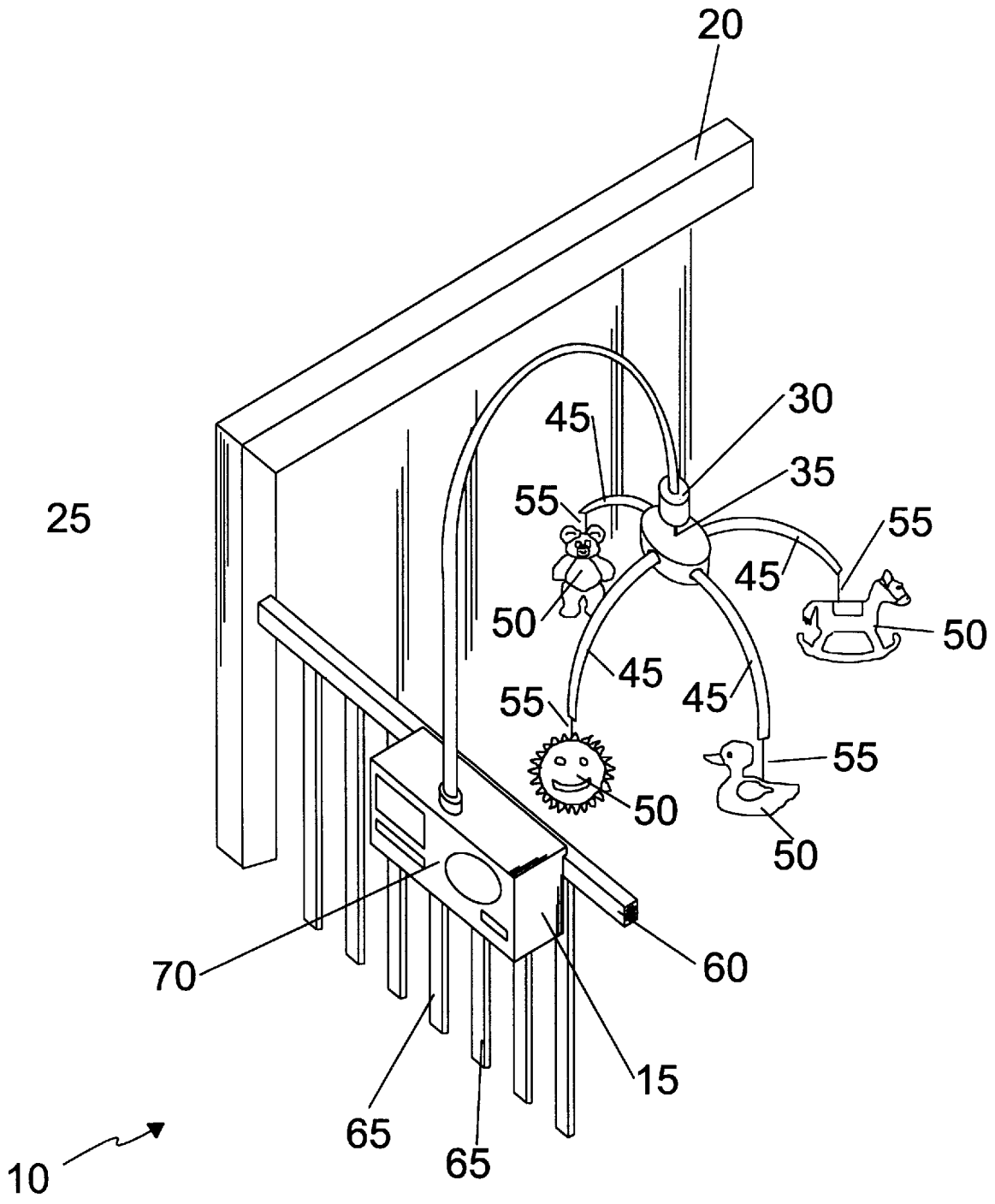
FIG. 1 is a perspective view of an infant mobile with compact disc/cassette player apparatus shown in a utilized state according to a preferred embodiment of the present invention.

The best mode for carrying out the invention is presented in terms of its preferred embodiment, herein depicted within the Figures 1. Detailed Description of the Figures Referring now to FIG. 1, a perspective view of an infant mobile with compact disc/cassette player apparatus 10 shown in a utilized state according to a preferred embodiment of the present invention is disclosed. An audio playback and control unit 15 is attached to the side of a conventional crib or playpen 20. The actual method of physical attachment will be described in greater detail hereinbelow. Exiting the top of the audio playback and control unit 15 in a generally central location is a support stand 25. The support stand 25 continues upward and gently curves in a 180° direction, where it terminates downward at an electric gear reduction motor 30. The electric gear reduction motor 30 possesses an output shaft 35 which is centrally terminated at a rotating hub 40. Extending radially outward from the rotating hub 40 is a plurality of fixture arms 45. Located at the opposing end of each fixture arms 45 is a mobile fixture 50 fastened by a connecting means 55 such as string, yarn or a monofilament line. It is envisioned that the support stand 25, the rotating hub 40, and the fixture arms 45 would be manufactured from plastic using an injection molding process. Such material is easily cleaned and presents a non-toxic surface should the infant place them in his or her mouth. It is envisioned that the mobile fixture 50 would be manufactured from a soft, flame retardant fabric, in a stuffed, quilted fashion, though it can be seen by those familiar in the art, that other safe materials such as plastic, wood, heavy cardboard and the like could also be utilized. The audio playback and control unit 15 is generally position able along a top rail 60 of the conventional crib or playpen 20 and centrally located between a pair of dividing slats 65 as shown. All of the operational controls of the infant mobile with compact disc/cassette player apparatus 10 are located on a front face 70 of the audio playback and control unit 15, and will be described in greater detail hereinbelow.

Figure 2:
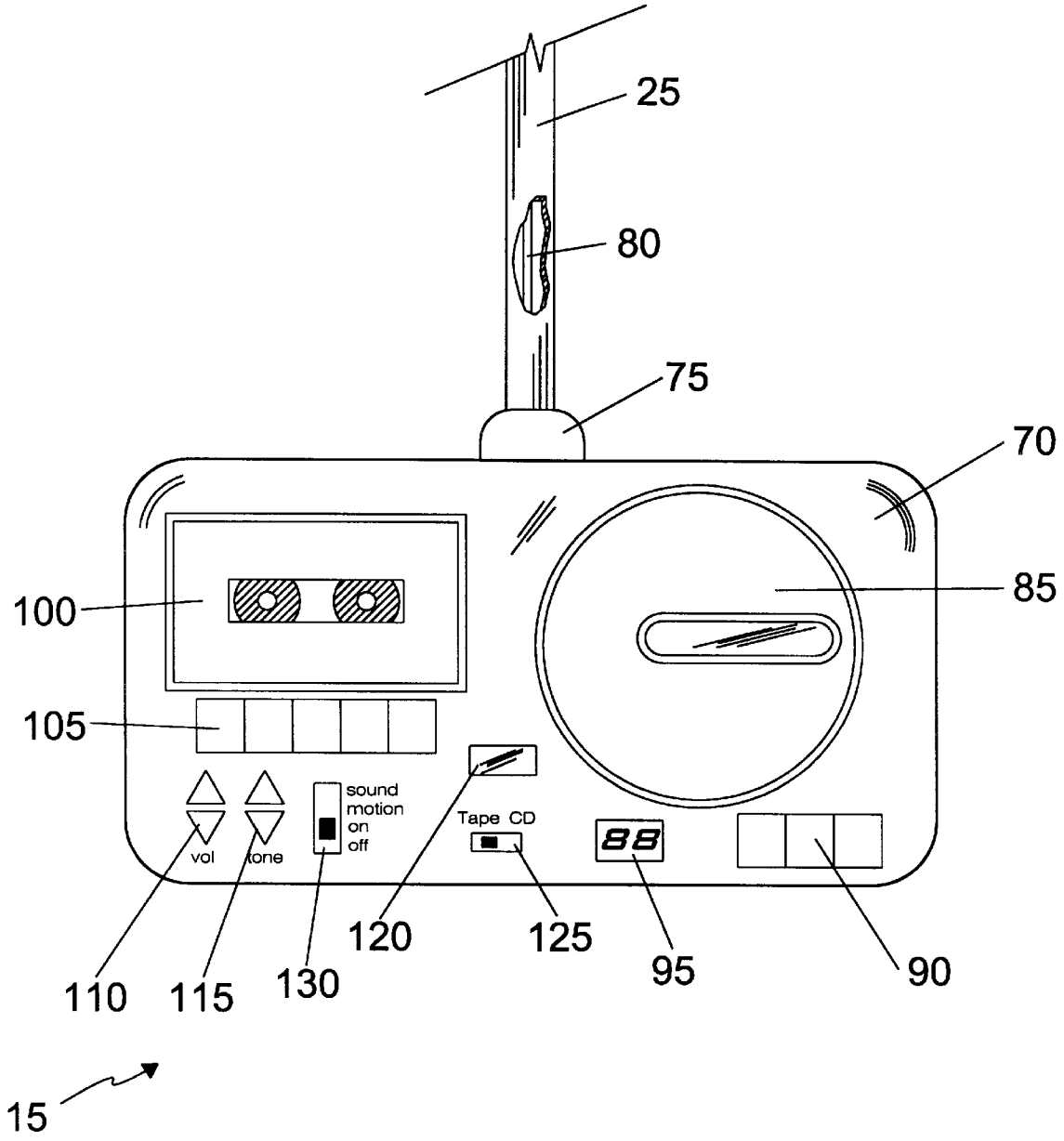
FIG. 2 is a front view of the audio playback and control unit associated with the present invention.

Referring next to FIG. 2, a front view of the audio playback and control unit 15 is depicted. Shown exiting the top of the audio playback and control unit 15 is the support stand 25. The support stand 25 is connected to the audio playback and control unit 15 via a snap-in plug assembly 75. The snap-in plug assembly 75 provides a physical means of support for the support stand 25 as well as providing an electrical connection to a motor conductor cable 80. The motor conductor cable 80 runs interior to the support stand 25 and is electrically connected at its opposing end to the electric gear reduction motor 30 (as shown in FIG. 1). The snap-in plug assembly 75 provides a method for closing and sealing the orifice created by the removal of the support stand 25 for the times when the mobile portion of the infant mobile with compact disc/cassette player apparatus 10 (as shown in FIG. 1) is not desired. Such times may be when the infant is older, and is no longer entertained by the mobile movement or when the infant is traveling and the parent or care giver only desires audio for the purposes of soothing or stimulating the infant. In such a scenario, a snap-in plug cover of an otherwise conventional type can be used to seal the cavity created by the removal of the snap in plug assembly 75. It is anticipated that the overall general design of the audio playback and control unit 15 would be such that it would be age and gender neutral to allow the use of the audio playback and control unit 15 alone up into adult life. Such a feature allows considerable cost savings compared to the cost of purchasing multiple units. Located on the front face 70 of the audio playback and control unit 15 is a compact disc player 85, where standard, conventional, audio compact discs may be inserted. Located immediately under the compact disc player 85 is a compact disc control panel 90, which allows for typical operations such as STOP, PLAY, TRACK SELECTION, and the like, and it's corresponding digital display 95 to indicate which track is selected on the compact disc. It is envisioned that the compact disc control panel 90 would allow for the continuous playing of a compact disc or a selection on a compact disc. This would be extremely beneficial in those instances where an infant requires a long period of time to fall asleep. Located on the left side of the front face 70 is a cassette player 100, in which standard, conventional, audio cassettes may be inserted. Positioned directly under the cassette player 100 is a cassette control panel 105, which could allow for the control of the cassette in the cassette player 100 by such typical operations as STOP, PLAY, FAST FORWARD, REWIND, PAUSE and the like. Positioned in the lower left-hand corner of the front face 70 is a volume control 110 for the purpose of controlling the overall sound volume emitted from the audio playback and control unit 15 and a tone control 115 for the purposes of controlling the overall sound quality emitted from the audio playback and control unit 15. Centrally positioned on the front face 70 of the audio playback and control unit 15 is an infrared access port 120. The infrared access port 120 would be utilized by a standard infrared remote control (not shown in this FIG.) to access and duplicate the features of the compact disc control panel 90, the cassette control panel 105, the volume control 110 and the tone control 115. This feature allows the parent or care giver to control the overall operation of the audio playback and control unit 15 from a remote location. This is beneficial in those instances where the parent or care giver is occupied across the room and thus saves time and effort on their part, or when the infant is just starting to fall asleep and the immediate presence of a parent or care giver may startle the infant and cause crying. Located under the infrared access port 120 is a tape/cd selector switch 125. The tape/cd selector switch 125 allows for either the playing of a cassette tape or a compact disc. It will not allow for the selection of both simultaneously. Finally, located on the front face 70 of the audio playback and control unit 15 is an operational mode control switch 130, which allows for one of four operational modes. First, is the OFF position which removes all sources of power from the audio playback and control unit 15, causing it to cease operation. Second, is the ON position which allows for the playing of a cassette or compact disc as selected by the tape/cd selector switch 125. This selection also allows for the synchronized movement of the mobile fixture 50 (as shown in FIG. 1) and will be more fully explained hereinbelow. Third, is the MOTION position, which allows for a standby type mode, when the infant is not in the conventional crib or playpen 20 (as shown in FIG. 1), or is asleep and motionless. Should the infant begin to move, both audio and movement of the mobile fixture 50(as shown in FIG. 1) will begin as aforementioned described under the ON position. Finally, a SOUND position is provided which utilizes a microphone, which will be described more fully hereinbelow, to sense ambient noise in the room or noise produced by the infant to allow for the actuation of the movement of the mobile fixture 50 (as shown in FIG. 1). The infant will soon realize that if he or she makes a noise, the mobile fixtures 50 (as shown in FIG. 1) will move, and when he or she ceases the noise, the mobile fixtures 50 (as shown in FIG. 1) will stop. Such action will entertain the infant as well as encourage knowledge and verbal development. It should be noted that the arrangement of all components on the front face 70 of the audio playback and control unit 15 is of a general nature for illustrative purposes and is not intended to be a limiting factor.

Figure 3:
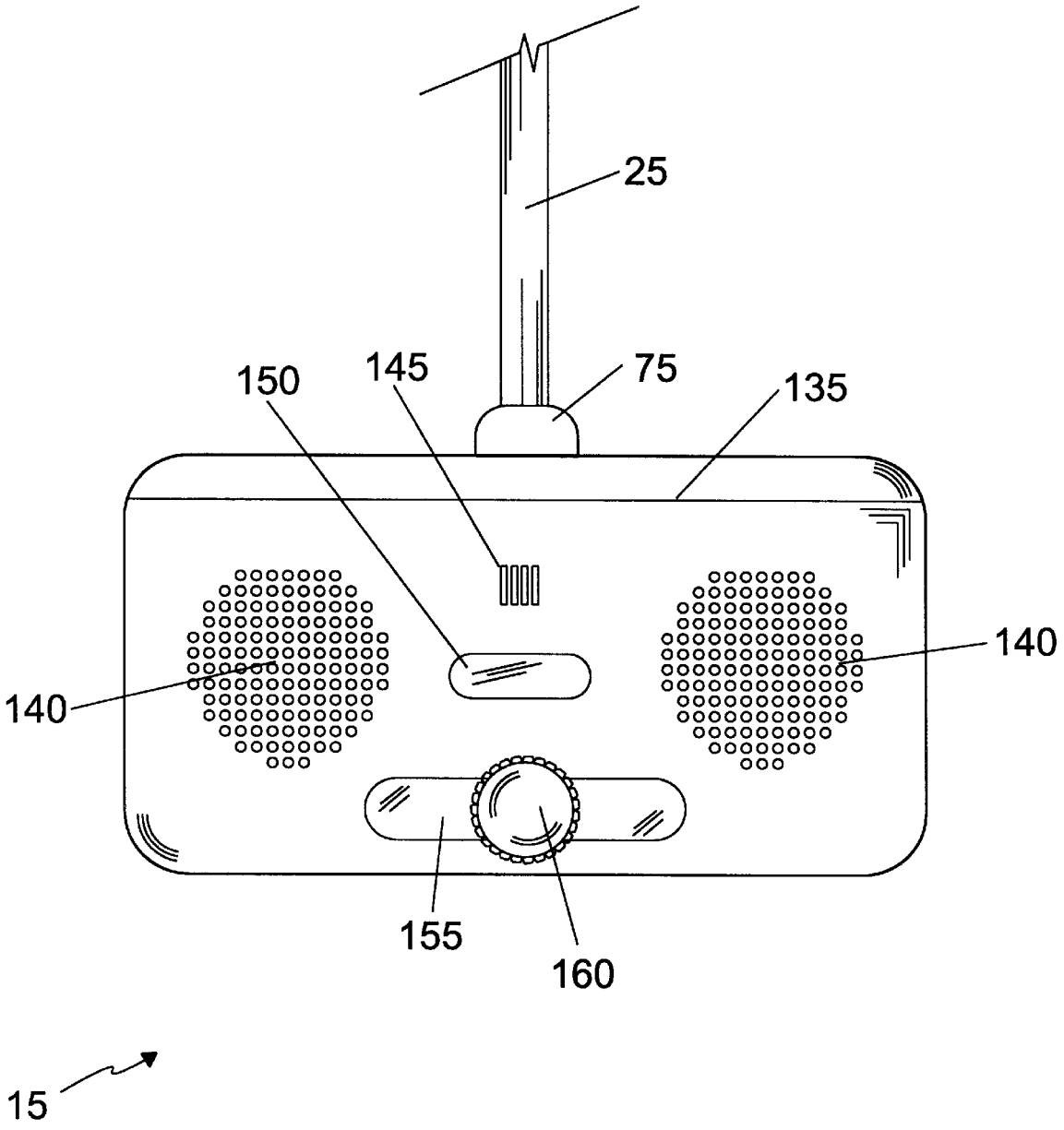
FIG. 3 is a rear view thereof.

Referring now to FIG. 3, a rear view of the audio playback and control unit 15 is shown. Once again the support stand 25 as connected by the snap-in plug assembly 75 is visible. A lip edge 135 is provided to aid in the attachment of the audio playback and control unit 15 to the top rail 60 (as shown in FIG. 1) and will be shown more clearly hereinbelow. A pair of speakers 140 is provided for the stereo reproduction of sound as provided by the compact disc player 85 or the cassette player 100 (as shown in FIG. 2). Centrally located on the upper half of the audio playback and control unit 15 is a microphone 145, which is used to sense the ambient room noise as aforementioned described under FIG. 2. Positioned under the microphone 145 is an infrared motion sensor 150, of conventional design, which is used to sense if the infant is present, stationary or moving in the conventional crib or playpen 20 (as shown in FIG. 1). Finally, located on the bottom, central portion of the audio playback and control unit 15 is a connection arm 155 and an attachment means 160, such as a knurled, threaded, knob. The connection arm 155 and the attachment means 160 are used to secure the audio playback and control unit 15 between two dividing slats 65 (as shown in FIG. 1) and will be shown in greater detail hereinbelow.

Figure 4:
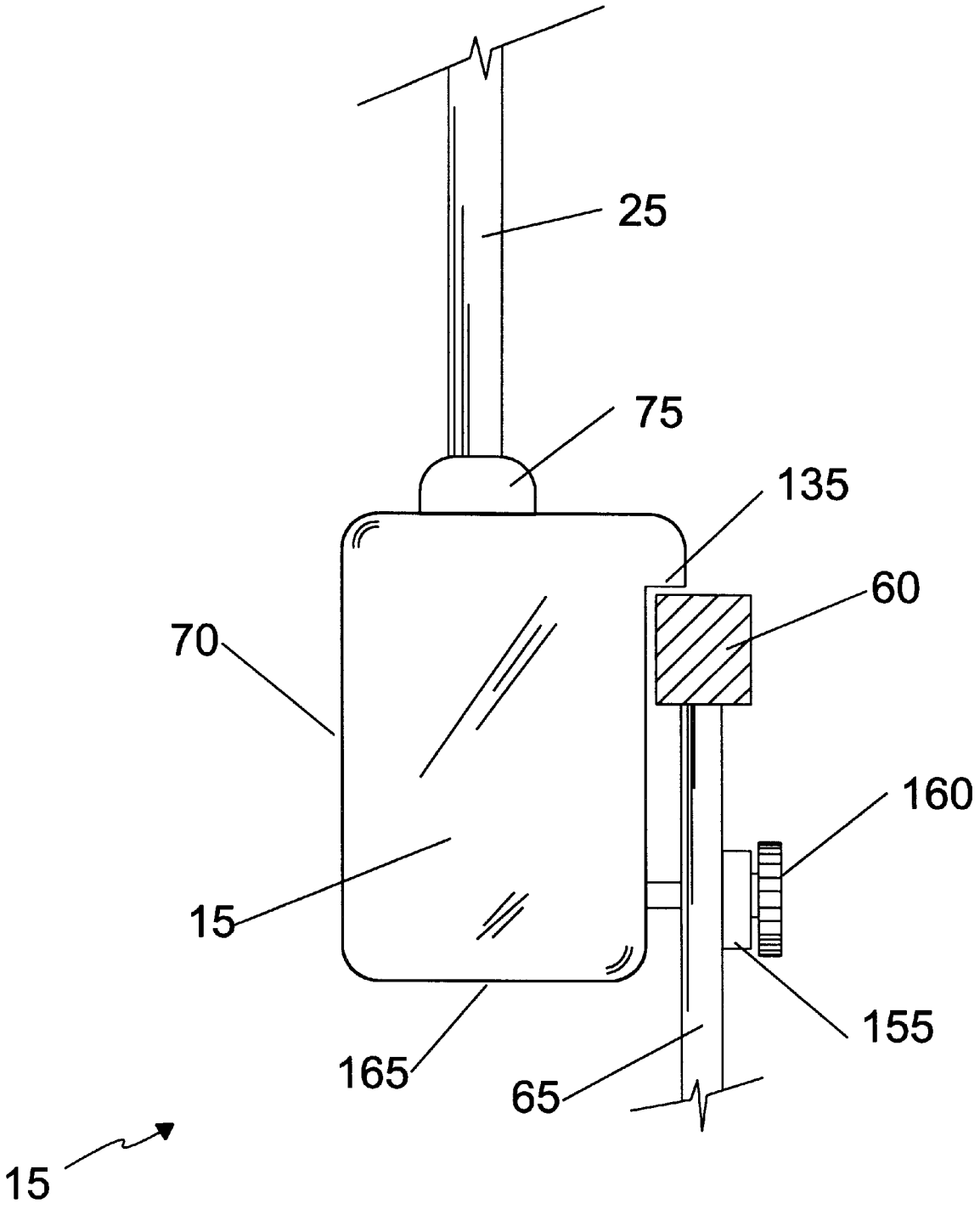
FIG. 4 is a side view thereof.

Referring next to FIG. 4, a side view of the audio playback and control unit 15 showed in an attached state to the top rail 60 and the dividing slats 65 is depicted. The lip edge 135 rests on the upper edge of the top rail 60 and is supported and secured via the connection arm 155 and the attachment means 160 as routed in between two adjacent dividing slats 65. Such an arrangement is general in nature and is readily adaptable to many different size conventional cribs or playpens 20 (as shown in FIG. 1). Additionally, such an arrangement provides for keeping access points and control points located on the front face 70 of the audio playback and control unit 15 at a maximum possible distance away from the infant, who would be located on the opposite side of plane defined by the vertical axis of the dividing slats 65. The support stand 25 as connected to the audio playback and control unit 15 by the snap-in plug assembly 75 is located towards the front face 70 side of the audio playback and control unit 15 for the same reason. The exterior surface of the audio playback and control unit 15 as well as the connection arm 155 and the attachment means 160 is envisioned to be manufactured from plastic using an injection molding process. Such material is easily cleaned and presents a non-toxic surface should the infant place them in his or her mouth. Additionally, all corner surfaces as presented by the audio playback and control unit 15 and its associated components are of a large rounded radius where possible, thus reducing the chances of injury should the infant strike them. Finally, a bottom surface 165 as provided on the bottommost surface of the audio playback and control unit 15 is flat in nature. This characteristic allows for the audio playback and control unit 15 to be used as a standalone music reproduction system. This would occur when the audio playback and control unit 15 was removed from the top rail 60 and the dividing slats 65 and the support stand 25 was removed via the snap-in plug assembly 75 on the top of the audio playback and control unit 15. At this point the audio playback and control unit 15 could be placed on any flat surface and utilized.

Figure 5:
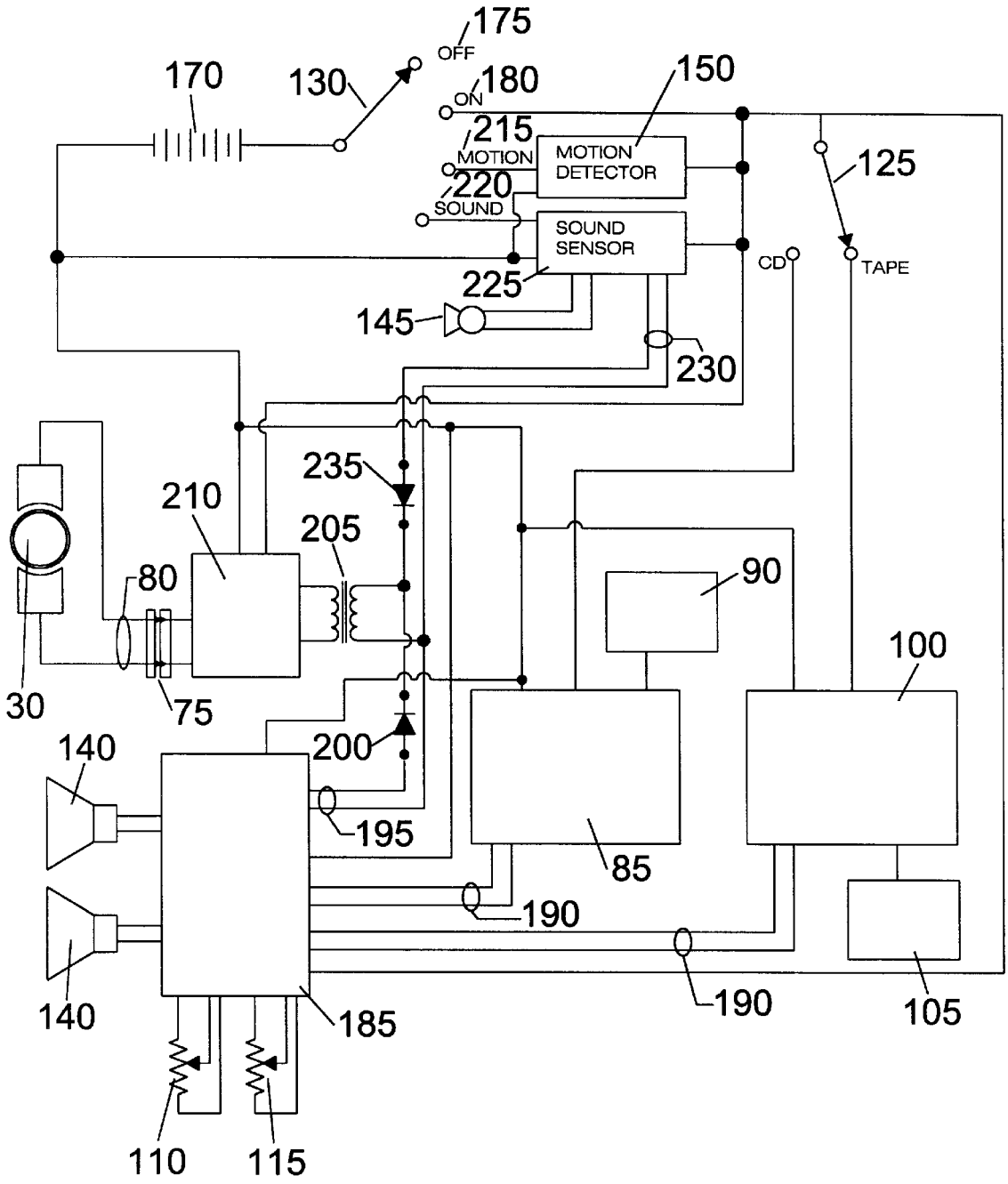
FIG. 5 is a schematic diagram of the electrical circuitry associated with the preferred embodiment of the present invention.

Referring finally to FIG. 5, a schematic diagram of the electrical circuitry associated with the infant mobile with compact disc/cassette player apparatus 10 is shown. A power source 170, such as a battery pack, is routed through the operational mode control switch 130. In a first position 175 the infant mobile with compact disc/cassette player apparatus 10 is off. In a second position 180, power is routed to a stereo amplifier 185 and the compact disc player 85 or the cassette player 100 as selected by the tape/cd selector switch 125. The compact disc player 85 is controlled by the compact disc control panel 90 and the cassette player 100 is controlled by the cassette control panel 105. Audio signals 190 are then routed into the stereo amplifier 185 where they are emitted through speakers 140 as controlled by the volume control 110 and the tone control 115. The stereo amplifier 185 produces a first synchronization signal 195 which is an analog signal directly proportional to the audio signals 190. The first synchronization signal 195 is routed through a first isolation diode 200 and then through an isolation transformer 205 where it is inputted into a synchronization drive circuit 210. The synchronization drive circuit 210 through the use of a gated transistorized drive circuit, converts the first synchronization signal 195 into a direct current voltage which varies in amplitude and polarity with the levels of the first synchronization signal 195. The resultant output is routed through the snap-in plug assembly 75 and carried on the motor conductor cable 80 to the electric gear reduction motor 30. The resultant operation will cause the electric gear reduction motor 30 to speed up, slow down, stop, start, and reverse direction in synchronization with the music signal being played. When the operational mode control switch 130 is in a third position 215 position, power is routed through the infrared motion sensor 150. When motion is sensed after a preset time delay, power is then applied to the same electrical point as the second position 180, and an identical operational sequence occurs as aforementioned described. In a fourth position 220 position power is applied to a sound sensing circuit 225 of conventional design. An input signal to the sound sensing circuit 225 is provided by the microphone 145 to sense ambient room noise or noise made by the infant. A second synchronization signal 230, formed as an output of the sound sensing circuit 225, and consisting of an analog signal directly proportional to the intensity of the sound as heard by the microphone 145, is then passed onto a second isolation diode 235 and the isolation transformer 205, where it continues on a path as aforementioned described when the operational mode control switch 130 was in the second position 180. Thus it can be seen that as the infant makes a noise, or when ambient noise levels are at a relatively moderate level, the electric gear reduction motor 30 will start, stop, slow down, speed up, and reverse directions in response to these levels.

2. Operation of the Preferred Embodiment

In operation, the present invention can be easily utilized by the common user in a simple and effortless manner. To use the present invention with its preferred embodiment can best be described in conjunction with the perspective view of FIG. 1, the views of FIG. 2, FIG. 3, and FIG. 4 and the schematic diagram of FIG. 5.

To use the present invention, the user would first fasten the audio playback and control unit 15 to the top rail 60 and the dividing slats 65 of the conventional crib or playpen 20 by utilizing the lip edge 135, the connection arm 155, and the attachment means 160. The user would then elect to play a cassette in the cassette player 100 or a compact disc in the compact disc player 85. After placing the media in the appropriate player, the user would select the appropriate player by use of the tape/cd selector switch 125. Next, the user would select the desired operational mode by use of the operational mode control switch 130. The user would select the second position 180 or ON position should uninterrupted music and mobile movement be desired. The user would select the third position 215 should the activation of music and mobile movement by the movement on part of the infant be desired. The user would select the fourth position 220 position should direct activation of the mobile movement mechanism by ambient room noise or infant produced noise be desired. Whatever operational mode is selected, at this point the infant mobile with compact disc/cassette player apparatus 10 is ready to soothe and/or stimulate the infant.

The user may elect to control the operational characteristics of the compact disc player 85 or the cassette player 100 by remote control via utilization of the infrared access port 120. Additionally, volume control as governed by the volume control 110 and tone control as governed by the tone control 115 is also available through the remote control and associated infrared access port 120. After the desired operation has taken place, the user may elect to deactivate the infant mobile with compact disc/cassette player apparatus 10 by placing the operational mode control switch 130 in its first position 175.

Should the infant no longer require the benefits of a mobile, the support stand 25 may be removed from the audio playback and control unit 15 by pulling it directly outward and disconnecting it at the snap-in plug assembly 75. The connection arm 155 and the associated attachment means 160 may then be removed and the audio playback and control unit 15 used as a standalone conventional music reproduction system. This feature may also be used when traveling with the infant or temporarily located at another location.

The foregoing description is included to illustrate the operation of the preferred embodiment and is not meant to limit the scope of the invention. The scope of the invention is to be limited only by the following claims.

What is claimed is:

1. An infant mobile with compact disc/cassette player apparatus comprising:

an audio playback and control unit, said unit being capable of attachment to the side of a conventional crib or playpen;

a support stand, said support stand affixed at a generally central location on the top of the audio playback and control unit, said support stand protruding upward therefrom and gently curving in a 180° direction, where it terminates downward at an electric gear reduction motor, a motor conductor cable running through the support stand from the unit to the motor wherein said support stand is connected to the audio playback and control unit via a snap-in plug assembly, said snap-in plug assembly provides a physical means of support for the support stand as well as providing an electrical connection to said motor conductor cable and wherein said snap-in plug assembly provides a method for the removal of the support stand for the time when the mobile portion of the infant mobile with compact disc/cassette player apparatus is not desired;

said electric gear reduction motor including an output shaft which is centrally terminated at a rotating hub, and extending radially outward from the rotating hub is a plurality of fixture arms; and a plurality of mobile fixtures, each said mobile fixture located at the opposing end of each said fixture arms and fastened by a connecting means.

2. The infant mobile with compact disc/cassette player apparatus of claim 1, wherein located on the front face of the audio playback and control unit is a compact disc player where standard, conventional, audio compact discs may be inserted, and further located immediately under the compact disc player is a compact disc control panel which allows for typical operations including STOP, PLAY, TRACK SELECTION.

3. The infant mobile with compact disc/cassette player apparatus of claim 2, wherein located on the left side of the front face of the audio playback and control unit is a is a cassette player in which standard, conventional, audio cassettes may be inserted, and wherein positioned directly under the cassette player is a cassette control panel, which controls the cassette in the cassette player by operations including STOP, PLAY, FAST FORWARD, REWIND, PAUSE.

4. The infant mobile with compact disc/cassette player apparatus of claim 3, wherein located on the front face of the audio playback and control unit is an infrared access port, said infrared access port for use with an infrared remote control to access and duplicate the features of the compact disc control panel and the cassette control panel.

5. The infant mobile with compact disc/cassette player apparatus of claim 4, wherein located under the infrared access port is a tape/cd selector switch, said tape/cd selector switch allowing for either the playing of a cassette tape or a compact disc.

6. The infant mobile with compact disc/cassette player apparatus of claim 5, wherein said infant mobile with compact disc/cassette player apparatus further comprises:

a power source routed to an operational mode control switch;

an operational mode control switch having first, second, third and fourth positions, wherein in said first position the infant mobile with compact disc/cassette player apparatus is off and in said second position power is routed to a stereo amplifier and the compact disc player or the cassette player as selected by said tape/cd selector switch;

a stereo amplifier producing a first synchronization signal and a second synchronization signal, said first synchronization signal being an analog signal directly proportional to an audio output signal and routed through a first isolation diode and then through an isolation transformer where it is inputted into a synchronization drive circuit which converts the first synchronization signal into a direct current voltage which varies in amplitude and polarity with the levels of the first synchronization signal, the resultant output being routed through the snap-in plug assembly and carried on the motor conductor cable to the electric gear reduction motor, the resultant operation will cause the electric gear reduction motor to speed up, slow down, stop, start, and reverse direction in synchronization with the music signal being played when said mode control switch is in said third position;

a sound sensing circuit having a microphone for suppling a sound sensing circuit input;

the second synchronization signal formed as an output of the sound sensing circuit, and consisting of an analog signal directly proportional to the intensity of the sound as heard by the microphone passed onto a second isolation diode and the isolation transformer, where it continues on a path as aforementioned described when the operational mode control switch was in the second position, and wherein when an infant makes a noise, or when ambient noise levels are at a relatively moderate level, the electric gear reduction motor will start, stop, slow down, speed up, and reverse directions in response to these levels when said mode control switch is in said fourth position;

and wherein audio signals are routed into the stereo amplifier where they are emitted through speakers as controlled by a volume control and a tone control.

* * * * *